US005563363A

United States Patent [19]

Soulaigre et al.

[11] Patent Number: 5,563,363

[45] Date of Patent: Oct. 8, 1996

[54] MECHANISM AND METHOD FOR INSERTING A MUNITION

[75] Inventors: Gérard Soulaigre, La Chapelle Saint Ursin; Robert Vernet, Juillan, both of France

[73] Assignee: Giat Industries, Versailles, France

[21] Appl. No.: 471,727

[22] Filed: Jun. 6, 1995

[30] Foreign Application Priority Data

Jun. 16, 1994 [FR] France ..... 94 07355

[51] Int. Cl.[6] ..... F41A 9/42

[52] U.S. Cl. ..... 89/46; 89/47

[58] Field of Search ..... 89/45, 46, 47, 89/33.05

[56] References Cited

U.S. PATENT DOCUMENTS

| | | | |
|---|---|---|---|
| 1,682,323 | 8/1928 | Conlon | 89/47 |
| 2,459,572 | 1/1949 | Molins | 89/47 |
| 4,183,281 | 1/1980 | Hultgren et al. | 89/47 |
| 4,457,209 | 7/1984 | Scheuvich et al. | 89/45 |
| 4,566,369 | 1/1986 | Bierwirth et al. | 89/45 |

FOREIGN PATENT DOCUMENTS

| | | |
|---|---|---|
| 0051119 | 5/1982 | European Pat. Off. . |
| 2346667 | 10/1977 | France . |
| 2448121 | 8/1980 | France . |
| 3306935 | 8/1984 | Germany . |

*Primary Examiner*—Stephen M. Johnson
*Attorney, Agent, or Firm*—Oliff & Berridge

[57] ABSTRACT

A mechanism for inserting a munition into a chamber of a weapon includes a drive device, a munition feed device, a ramming device, a locking device and a retractable stop assembly. The drive device includes a drive element that drives the mechanism through a first rotation and a second rotation about the same axis of rotation. The munition feed device transports and feeds the munition, and the device is coupled to and rotationally driven by the drive device from an initial position through the first rotation to a ramming position and through the second rotation from the ramming position to a locking position. The ramming device is connected to and disposed to rotate with the munition feed device such that the ramming device is aligned with and disposed to ram the munition into the breech chamber when the mechanism is in the ramming position. The locking device is shaped to lock the munition and is connected to and disposed to rotate with the munition feed device such that the locking device is aligned with and disposed to lock the munition within the breech chamber when the mechanism is in the locking position. The retractable stop assembly is coupled to and shaped to cooperate with the drive element and the munition feed device to stop the munition feed device after the first rotation such that the mechanism is in the ramming position.

20 Claims, 11 Drawing Sheets

MECHANISM AND METHOD FOR INSERTING A MUNITION

BACKGROUND OF THE INVENTION

The object of the present invention is a mechanism for inserting a munition into the breech chamber of a medium- or large-caliber weapon, having a munition feed device which is rotationally driven by a drive device and at least one ramming device and one locking device for the munition, operating in succession, the ramming device and locking devices being rotationally coupled with the feed device. During one munition insertion cycle, the munition is aligned along the axis of the breech chamber and the ramming device is positioned to ram the munition in a first rotation, and in a second rotation, positioning the locking device to lock the munition in the forcing cone.

An insertion mechanism of this kind is known, as disclosed, in e.g. French Patent No. 2 448 121.

In this insertion mechanism the first and second rotations occur about two different axes, i.e., with a complex movement, resulting in a mechanical complexity that results in the insertion mechanism being fragile and incompatible with the demands of new types of artillery equipment.

SUMMARY OF THE INVENTION

An object of the present invention is to provide an insertion mechanism of the type described above which is both simpler and more robust.

The basic idea of the invention is to perform the two rotations about a single axis in order to achieve the desired simplicity, and consequently, to reduce the time of one complete loading cycle.

The insertion mechanism according to the invention includes a rotary element allowing the first and second rotations of the feed device to be performed about a single axis of rotation, interacting with a retractable stop device allowing rotation of the feed device to be stopped in a position corresponding to the end of the first rotation.

The retractable stop device can have a retraction device that displaces the stop device between two positions: a first, active position in which the stop device stops the rotation of the feed device at the end of the first rotation; and a second, inactive position in which the stop device is concealed and does not affect rotation of the feed device.

The retractable stop device includes a first stop lever that slides longitudinally with respect to the rotary element, but is rotationally coupled with the rotary element. The feed device includes structural elements for making the first stop lever slide along the rotary element between the first and second positions. The first stop lever can, in particular, have a peripheral groove, and the structural elements for displacing the first lever can include a fork that engages the groove.

According to a preferred embodiment, the retractable stop device has a second stop lever interacting with an end stop for the first rotation, the first stop lever being capable of driving the second stop lever only when it is in its first position.

The fork can be articulated about a pivot axis.

The fork can have a first and a second leg, each having a region, such as a pin, that engages the groove. The first leg can have, at one end, an actuating pin that is the structural element for making the first stop lever slide.

The insertion mechanism can have a rigid box supporting the drive device, the retractable stop device, and the rotary element.

The insertion mechanism can include an actuating device that provides the following rotation sequence for the feed device:

a) Displace the drive device to perform the first rotation, the retractable stop device being in its first position;

b) Move the retractable stop device into its second position;

c) Displace the drive device to perform the second rotation;

d) Displace the drive device to perform the return stroke of the second and first rotations; and e) Move the retractable stop device into its first position.

The mechanism can include a device for actuating, between steps a) and c), a forward displacement of the ramming device to perform the ramming of the munition and to actuate, between stages c) and d), a forward displacement of the locking device to perform the locking of the munition, and then a return displacement of the locking device.

According to a preferred embodiment, the mechanism has a device for actuating, during step d), a return displacement of the ramming device.

BRIEF DESCRIPTION OF THE DRAWINGS

The invention will be better understood by reading the description below in conjunction with the attached drawings, which show a preferred embodiment of the invention and in which.

DETAILED DESCRIPTION OF PREFERRED EMBODIMENTS

Figure 1:
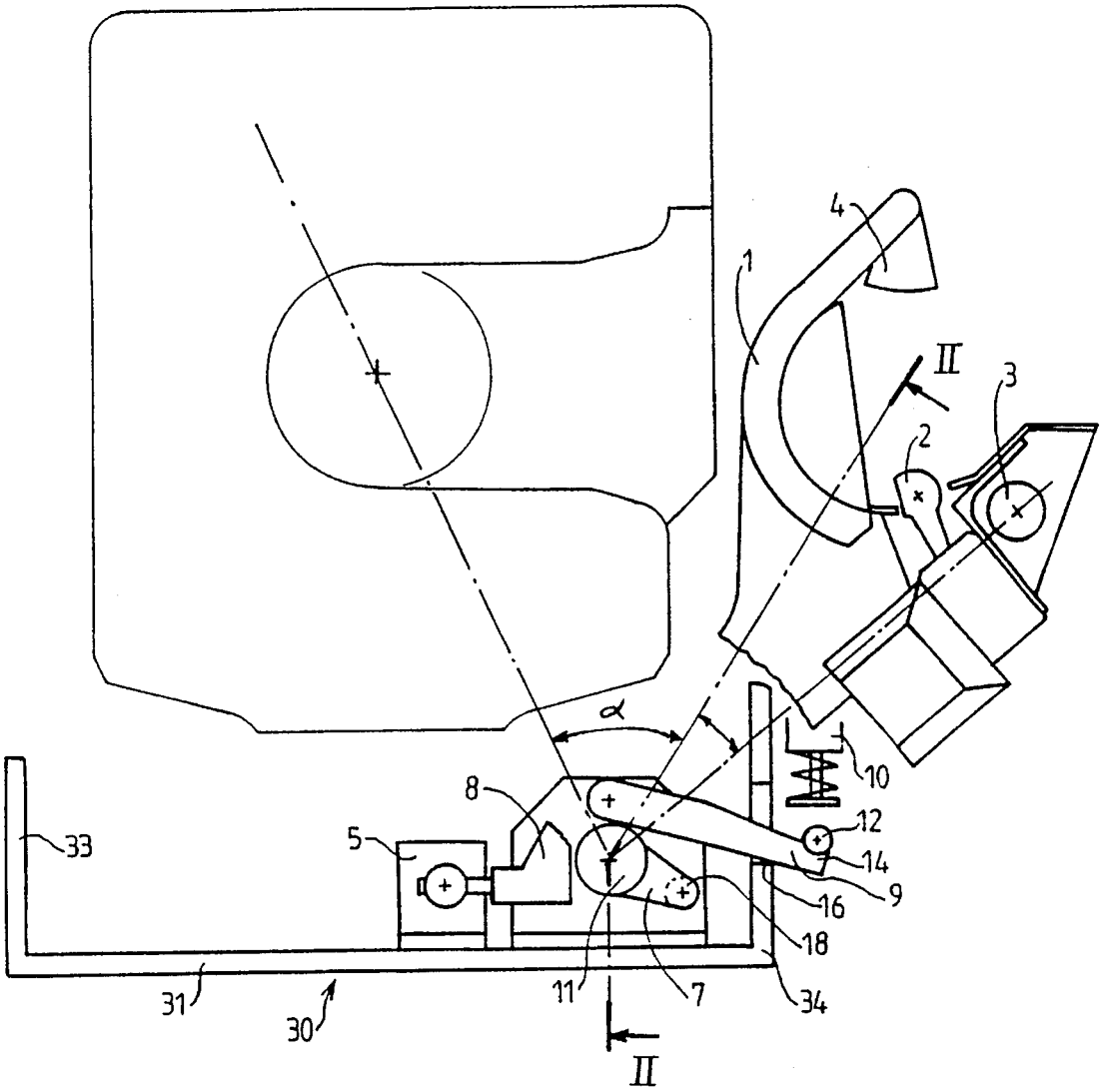
FIGS. 1 and 2 show, respectively in a front view and a right side view (partial section II—II of FIG. 1), a device according to the invention in position to introduce a munition.
Figure 2:
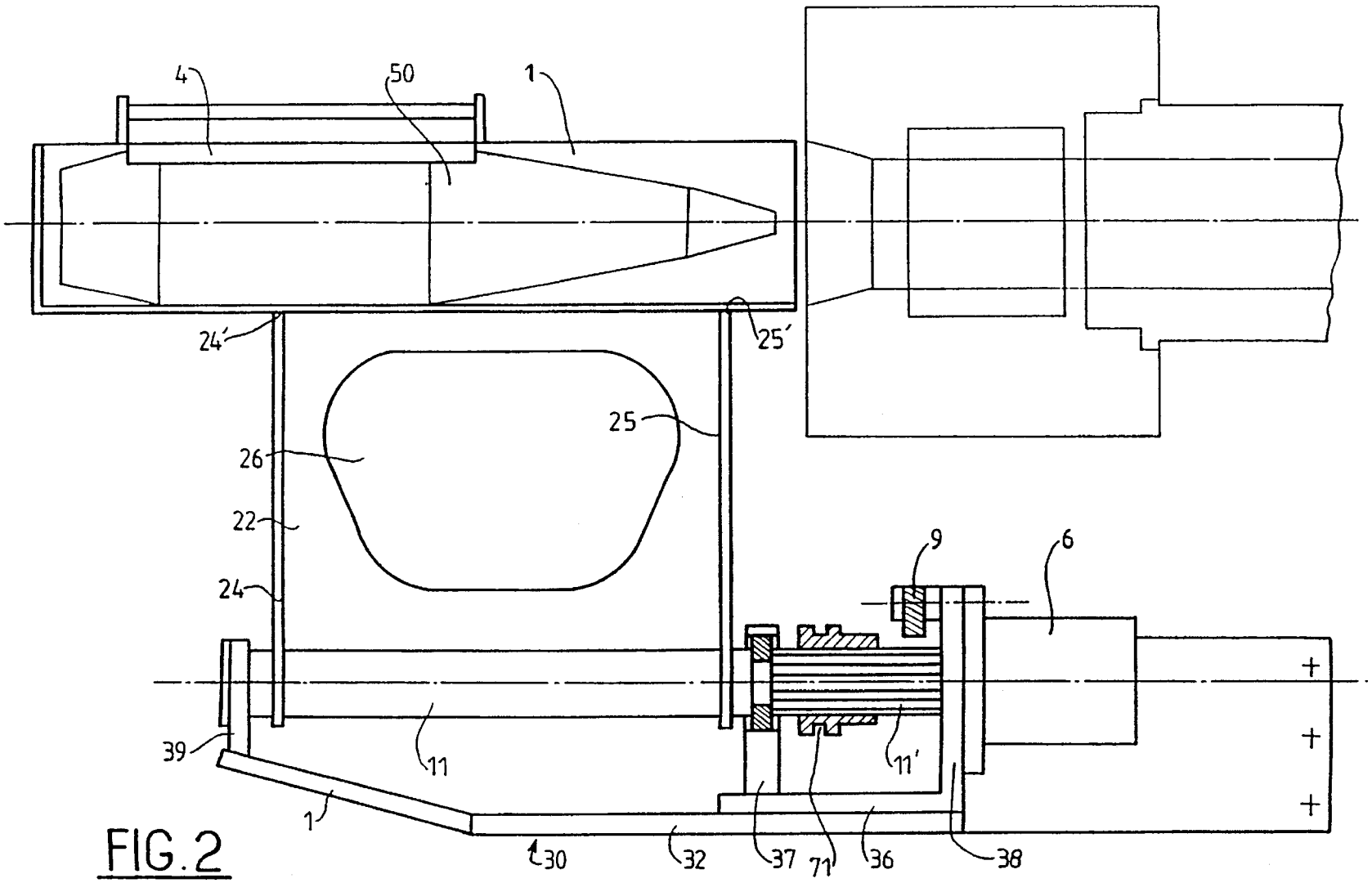

As FIGS. 1 and 2 show, a feed device for a munition 50 has a cradle 1 of semicircular shape, the concavity of which faces upward and which is equipped with an antiextraction device 4, which is known in the art, that is designed to prevent the ejection of the shell 50 as cradle 1 rotates. The cradle 1 is rotationally movable about a single axis, which is the rotational axis of a cylindrical element 11. It is mechanically connected to the cylindrical element 11 by a support having a plate 22 that includes a cutout 26 which extends radially from cylindrical element 11 to cradle 1, and two lateral support elements 24 and 25 orthogonal to the plate 22. The plate 22 includes ends 24' and 25' that surround the cradle 1 to make the assembly rigid.

The cradle 1 is rotationally driven by a rotary actuator 6 with a helical piston.

A chain rammer 2 moved by a hydraulic motor and a linear locking actuator 3 are mounted on the cradle 1 and are coupled with its rotation about the axis of the cylindrical element 11.

The assembly is powered by an electrohydraulic unit that is in turn controlled by an electrical control panel.

Figure 8:
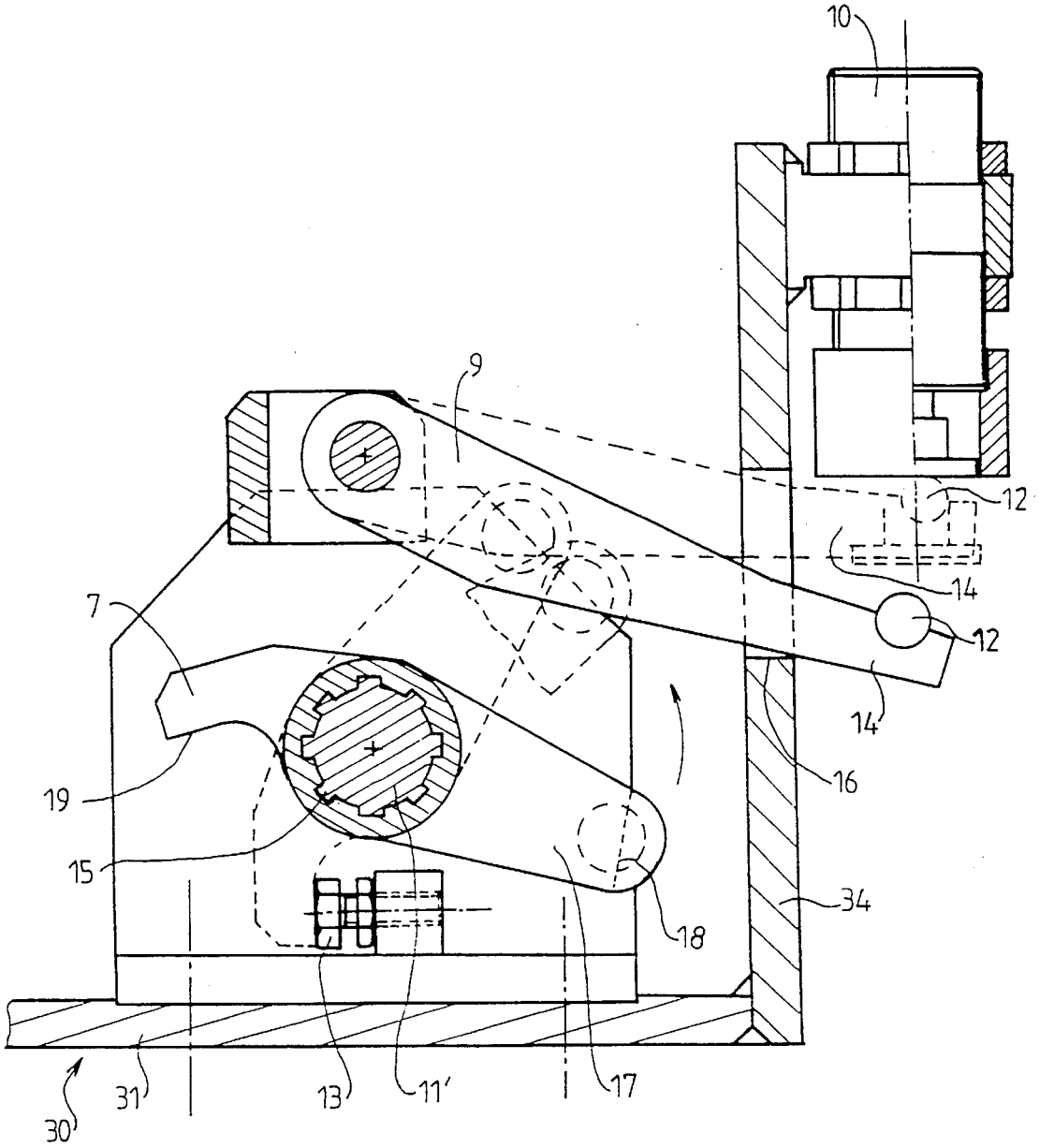
FIG. 8 is a cross section VIII—VIII of FIG. 7, illustrating two characteristic positions of the retractable stop device according to the invention.
Figure 9:
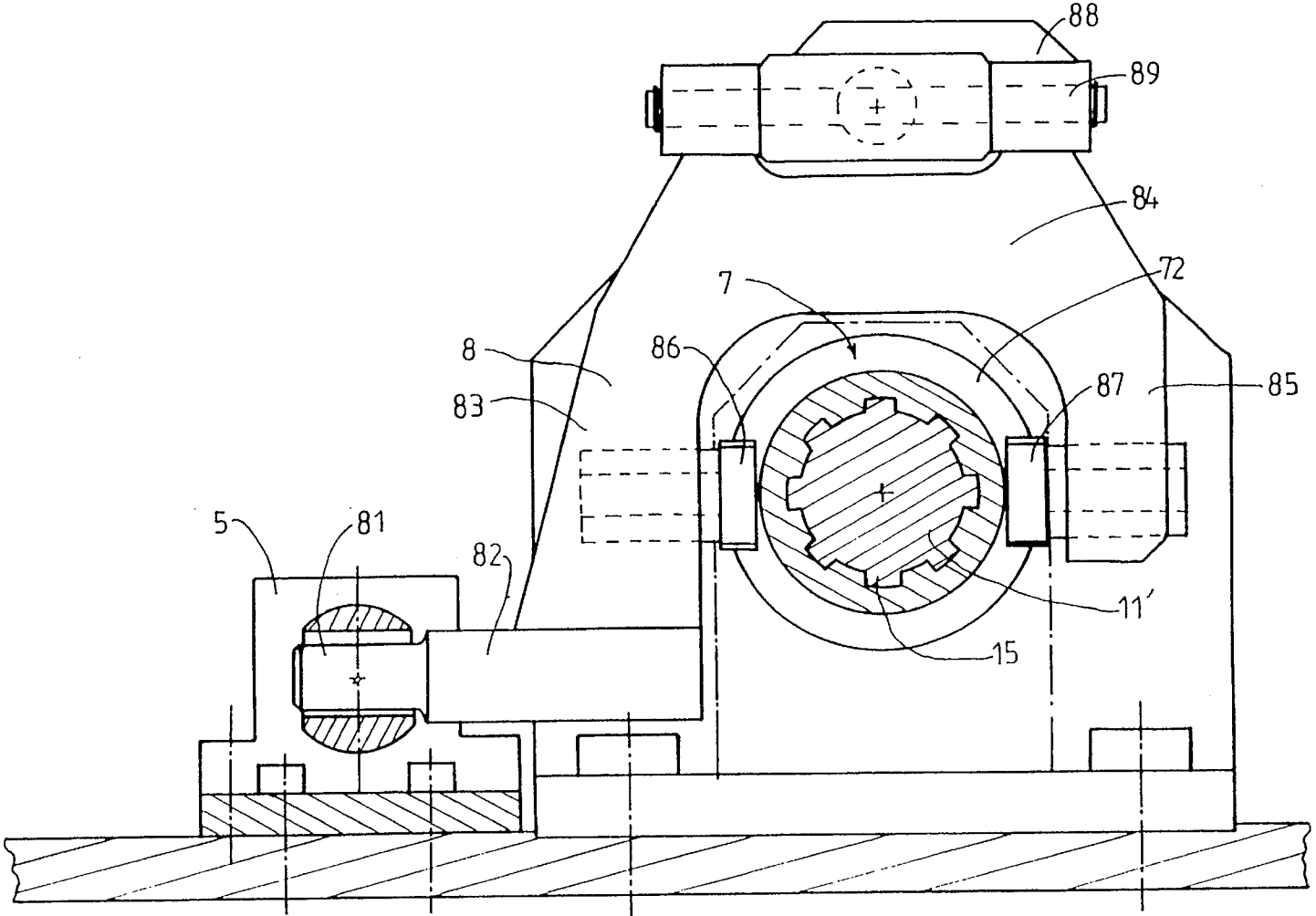
FIG. 9 is a cross section IX—IX of FIG. 7.

A lever 7 having a drive pin 18 is rotationally coupled to the cylindrical element 11, but its position along the cylindrical element 11 is controlled by a fork 8 operated by a stop actuator 5. The rotational drive of the lever 7, independently of its longitudinal position along the cylindrical element 11, is produced by complementary splines 15 of an extension 11' of the cylindrical element 11 and of the lever 7, which are shown in FIGS. 8 and 9.

The pin 18 of lever 7 allows rotational drive, up to a shock-absorbing stop 10, of a second lever 9 having at its end 14 a stop pin 12.

The fork 8 which is actuated by the stop actuator 5, allows longitudinal displacement of the lever 7 along the axis of the cylindrical element 11 between an active position in which the peg 18 is capable of rotationally driving the second lever 9, and an inactive position in which the rotation of the lever 7 cannot have any influence on the lever 9. The second lever 9 is returned, by its own weight or by a spring (not shown), into a low position in which it is disengaged from the stop 10 and comes to rest at its bottom dead center point on a lower edge 16 in an opening of one of the edges 34 of a U-shaped rigid support box 30 exhibiting a bottom plate 31 and a second edge 33. The box 30 stiffens the assembly and includes a U-shaped plate 36, legs 37 and 38 of which support the rotary actuator 6, the retractable stop mechanism 5, 7, 8, 9, and one end of the cylindrical element 11, the other end of which is retained by a flange 39 forming an extension of the bottom plate 31 which adjoins the edge 34.

The insertion mechanism operates according to the following cycle:

A shell 50 is placed in the cradle 1, which is in the introduction position shown in FIGS. 1 and 2. In this position, the chain rammer 2 is inactive. The piston of the linear locking actuator 3 is retracted, the piston of the stop actuator 5 retracted (see FIG. 7), which corresponds to the active position of the lever 7, and the rotary actuator 6 is inactive. The antiextraction device 4 prevents ejection of the shell during the first rotary movement of the cradle 1.

Figure 3:
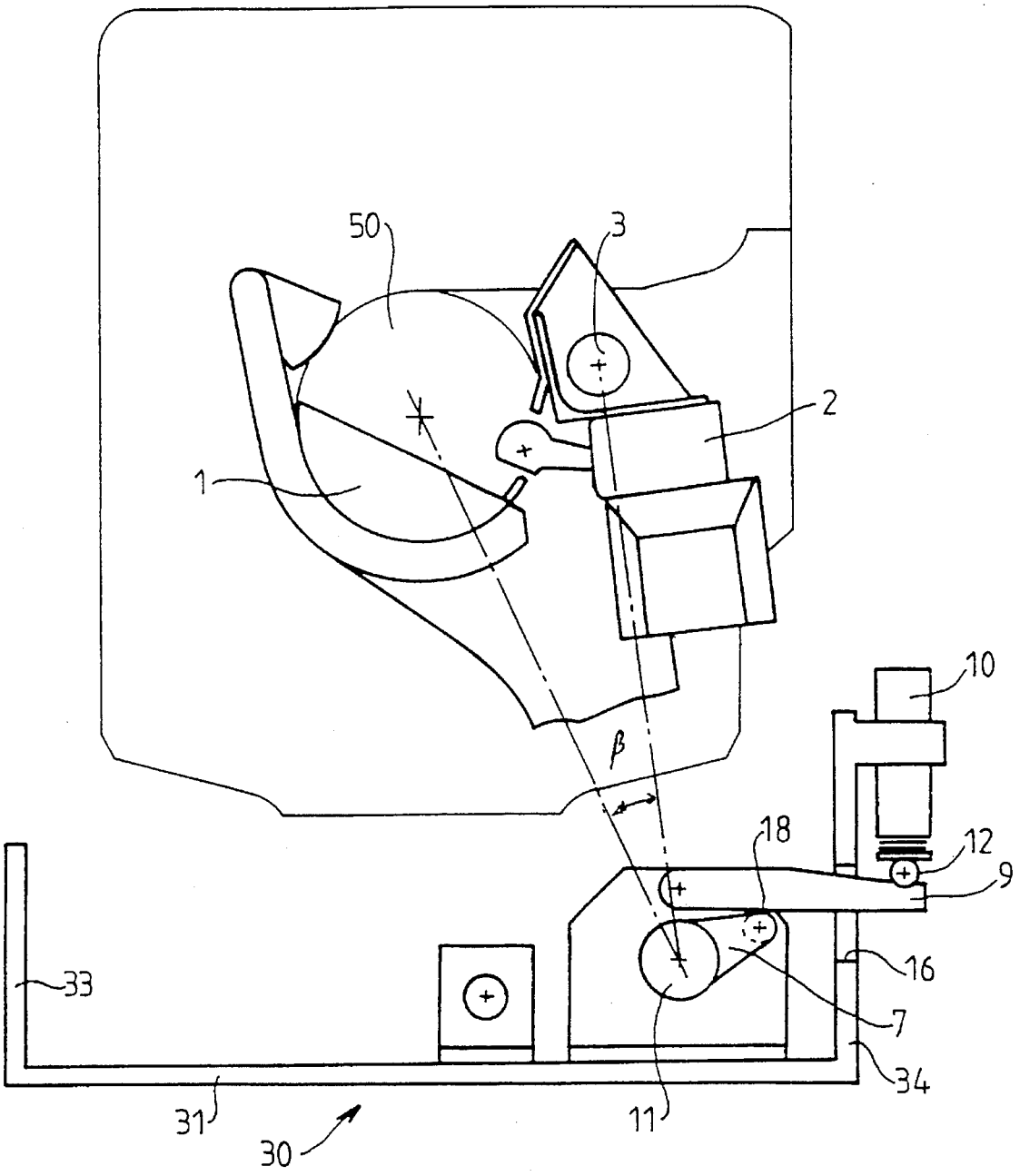
FIG. 3 shows the device of FIG. 1 after a first rotation of the feed device.
Figure 4:
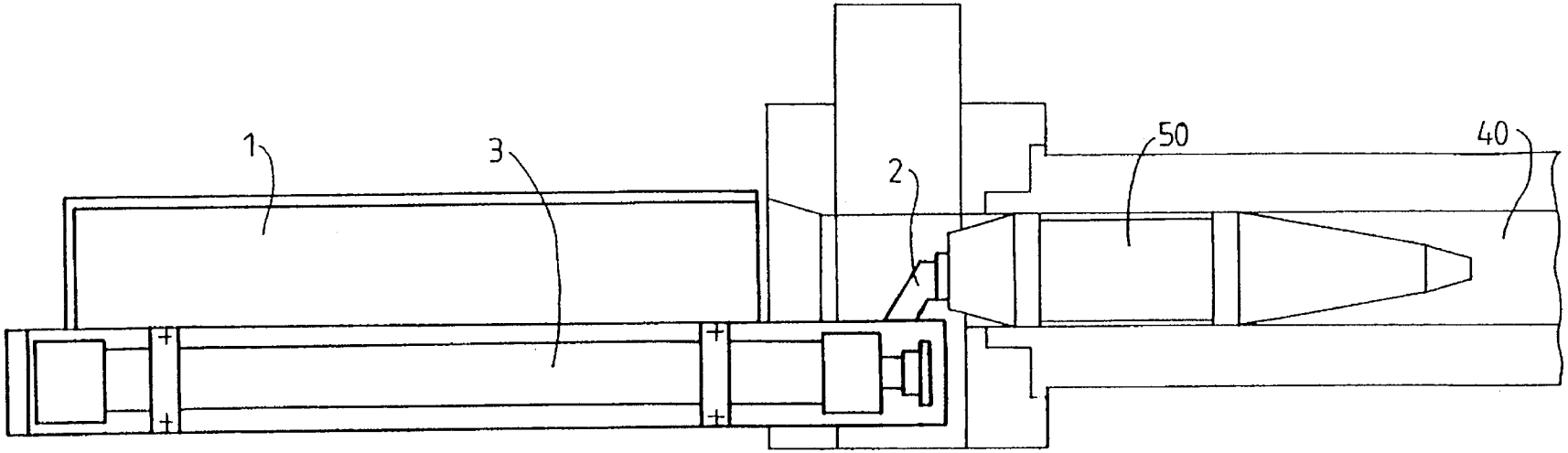
FIG. 4 shows, in a view from above, the introduction of the munition into the breech chamber of a gun.

A first rotation, through an angle $\alpha$, of the cradle 1 is performed about the axis of the cylindrical element 11 from the position shown in FIG. 1 to the position shown in FIG. 3, in which the second layer 9, driven by the pin 18, comes into contact with its stop pin 12 against the shock-absorbing stop 10. In this position, the axis of shell 50 is aligned with that of the breech chamber 40 of the gun, and the chain rammer 2 is in a position in which it can ram the shell 50 from the cradle 1 into the breech chamber 40. This ramming stage is initiated by a cradle position detector (not shown) which actuates forward motion of the chain rammer 2. In addition, a second position detector actuates extension of the piston of stop the actuator 5. As a result, the pin 18 is disengaged from the second lever 9, which falls to its bottom dead center point, and the lever 7 is released and continues its rotation without exerting any effect on the second lever 9.

Figure 5:
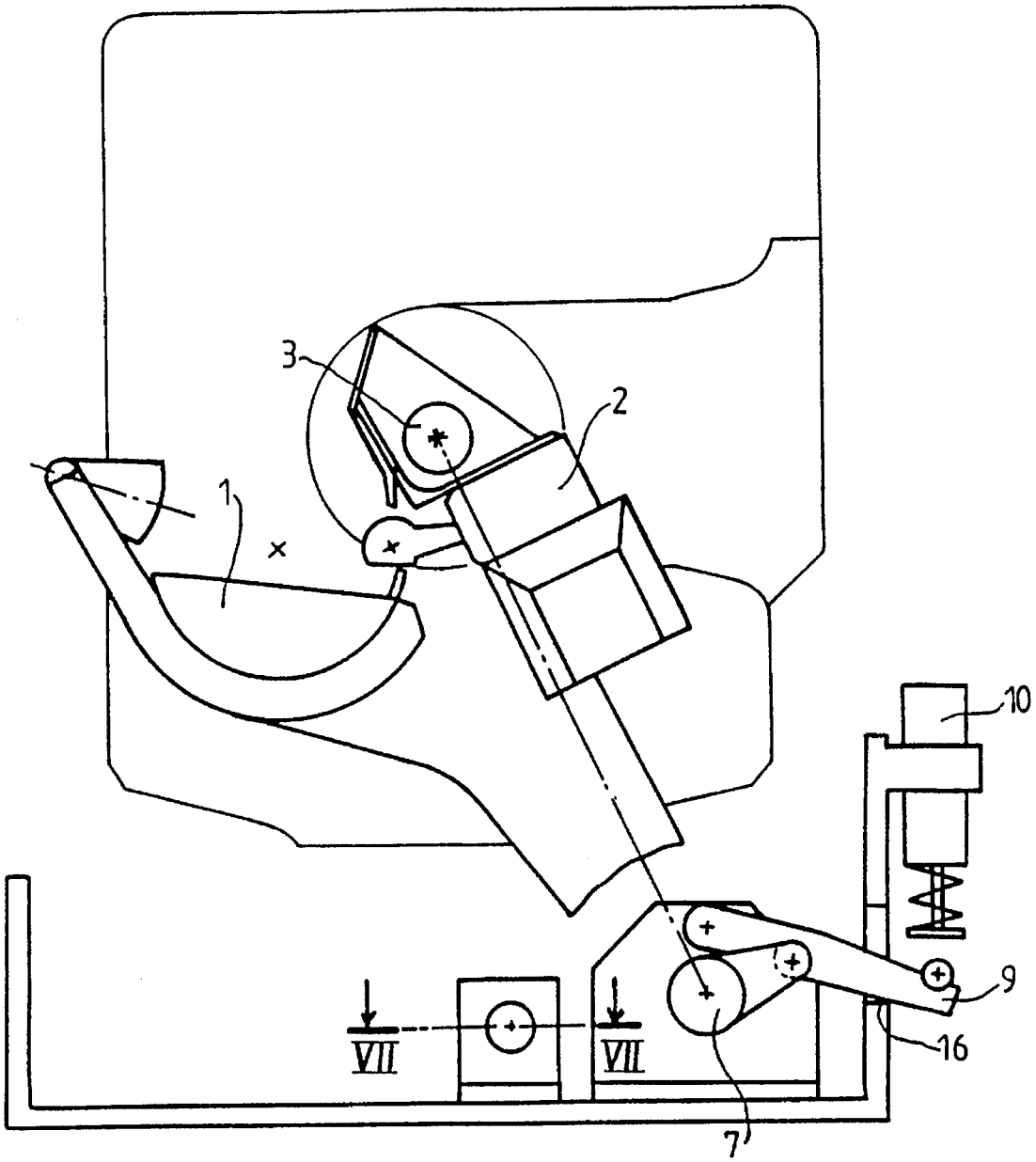
FIG. 5 shows the device of FIG. 3, after the second rotation of the feed device to position the locking actuator.
Figure 6:
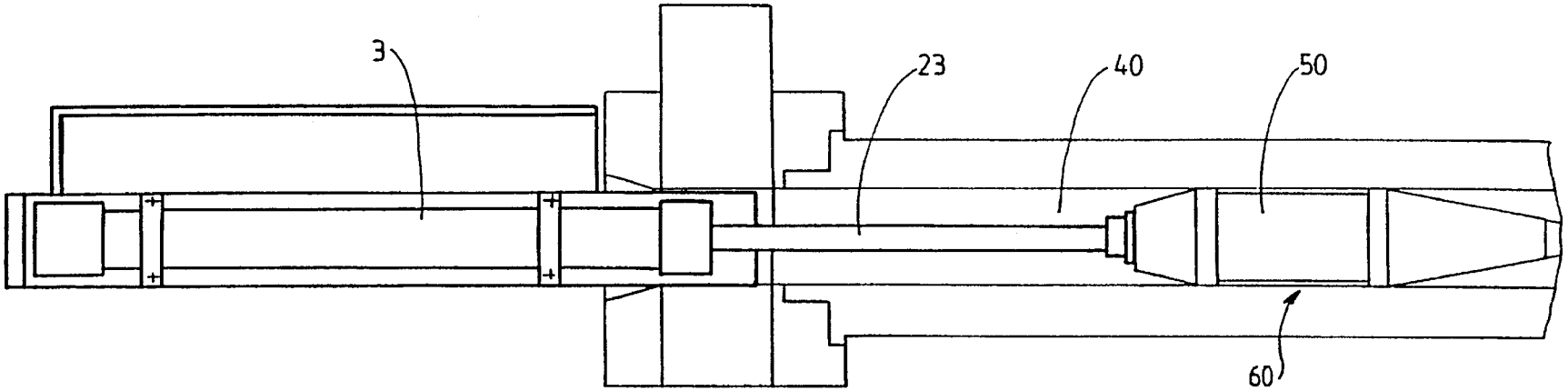
FIG. 6 shows, in a view from above, the completion of introduction and locking of the munition into the forcing cone of the gun barrel.

The cradle 1 then performs a second rotation through an angle $\beta$, again under the action of the rotary actuator 6 which has been left under pressure, from the position shown in FIG. 3 to the position shown in FIG. 5. In this second position (see FIG. 5), the locking actuator 3 is aligned with the breech chamber 40 of the barrel. The cradle 1 position detector actuates extension of the piston 23 of the locking actuator 3 and locks the shell 50 in firing position in the forcing cone 60 of the chamber 40.

An electrohydraulic device connected hydraulically to the piston 23 of the actuator 3 retracts the piston as soon as the oil flowrate drops. A piston 23 retraction detector (not shown) then actuates the return of the cradle 1 to the starting position (FIG. 1) and the return of the rammer 2. A final detector (not shown) in the starting position actuates the return of the stop actuator 5, which once again positions the lever 7 in the active position. The loading device is then ready for another cycle.

The device described above allows a savings in time because the rammer 2 can be returned entirely during otherwise active time, and because the arm rotation return time is faster than in the prior art on account of the single movement, which helps reduce the time for one complete cycle and consequently improves the firing rate of the equipment.

A description will now be given, in conjunction with FIGS. 7 to 10, of a preferred embodiment of the retraction device of the retractable stop.

Figure 7:
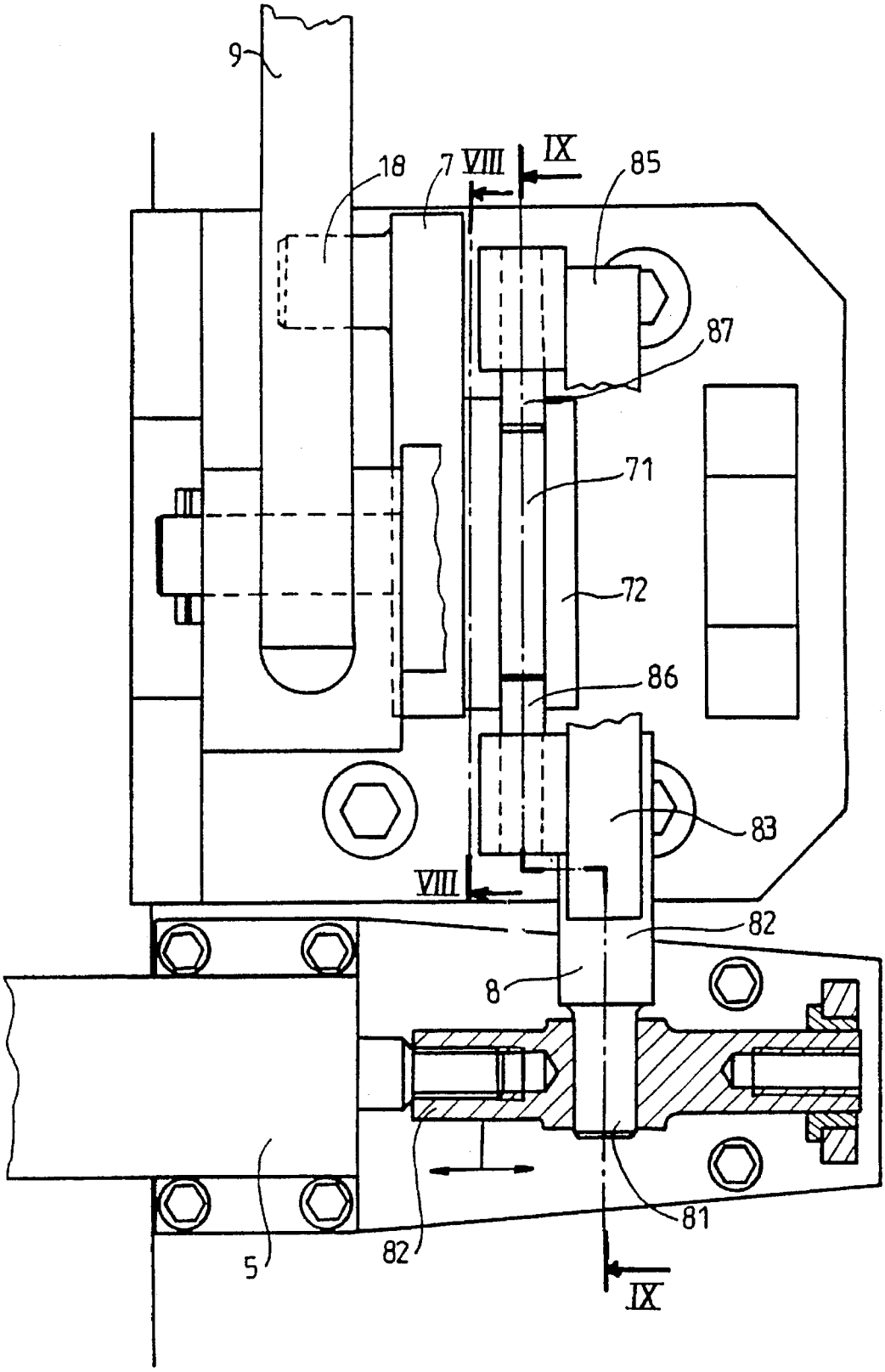
FIG. 7 shows, in a view from above with partial section VII—VII of FIG. 5, a preferred embodiment of the retraction device of the stop.

FIG. 7 shows the lever 7 in its active position, in which the peg 18 rotationally drives the second lever 9. This position corresponds to the retracted piston position of the stop actuator 5. The fork 8 is shaped generally in an inverted U (see FIG. 9) having one upper central leg 84 and two side legs 83 and 85 which extend downward. Arranged on an upper part 88, which lies above the central leg 84, is a pivot 89 allowing the fork 8 to be rotationally movable about a horizontal axis perpendicular to the rotational axis of the cylindrical element 11. The lower part of leg 83 has an extension 82 which makes it possible to actuate displacement of the fork 8. In addition, the middle parts of the legs 83 and 85 have carry extensions 86 and 87 which engage in a groove 71 of a cylindrical element 72 extending from the lever 7 along the axis of the cylindrical element 11.

Figure 10:
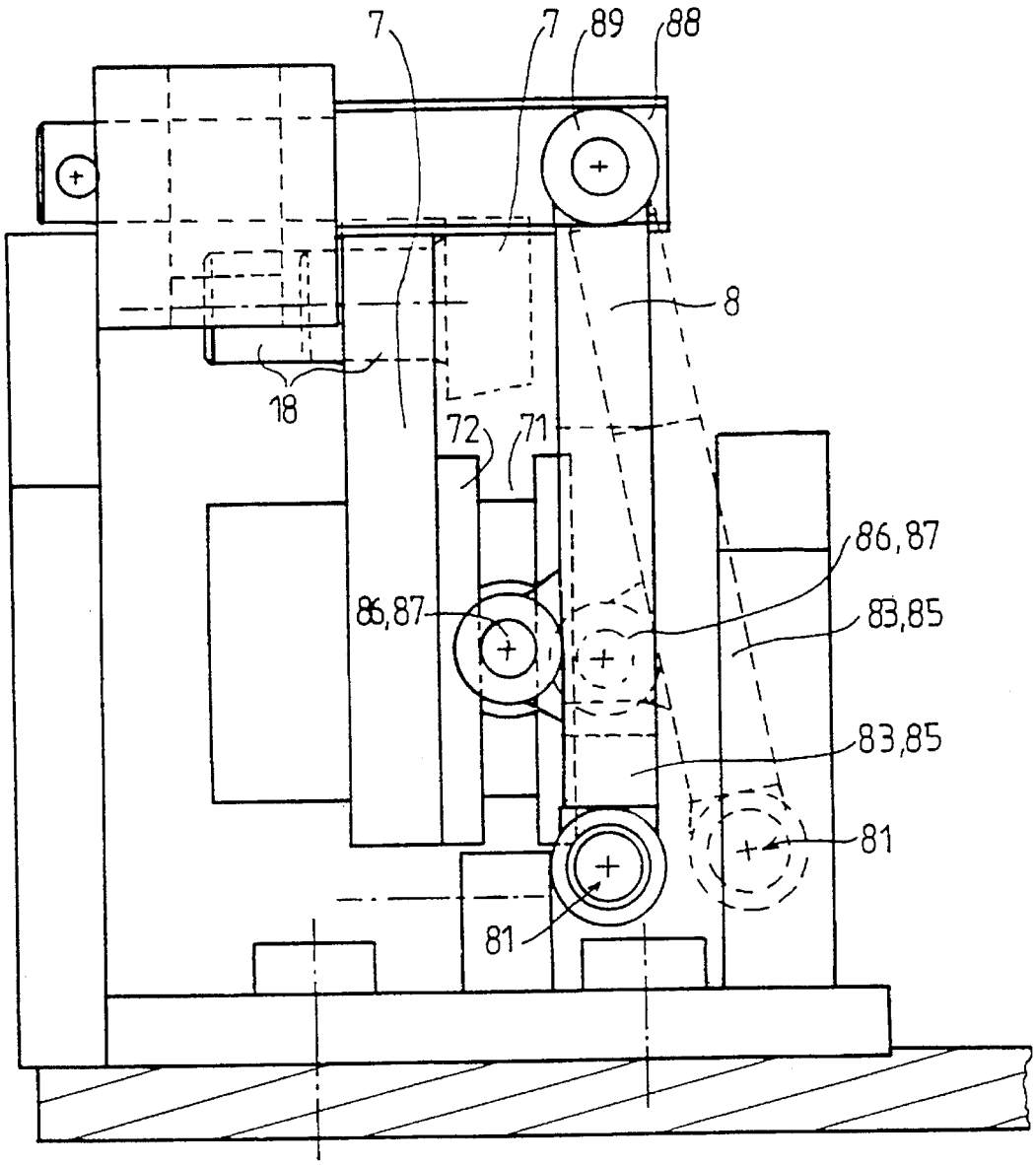
FIG. 10 is a side view of FIG. 9 illustrating two characteristic positions of the displacement of the fork according to one preferred embodiment of the invention.
Figure 11:
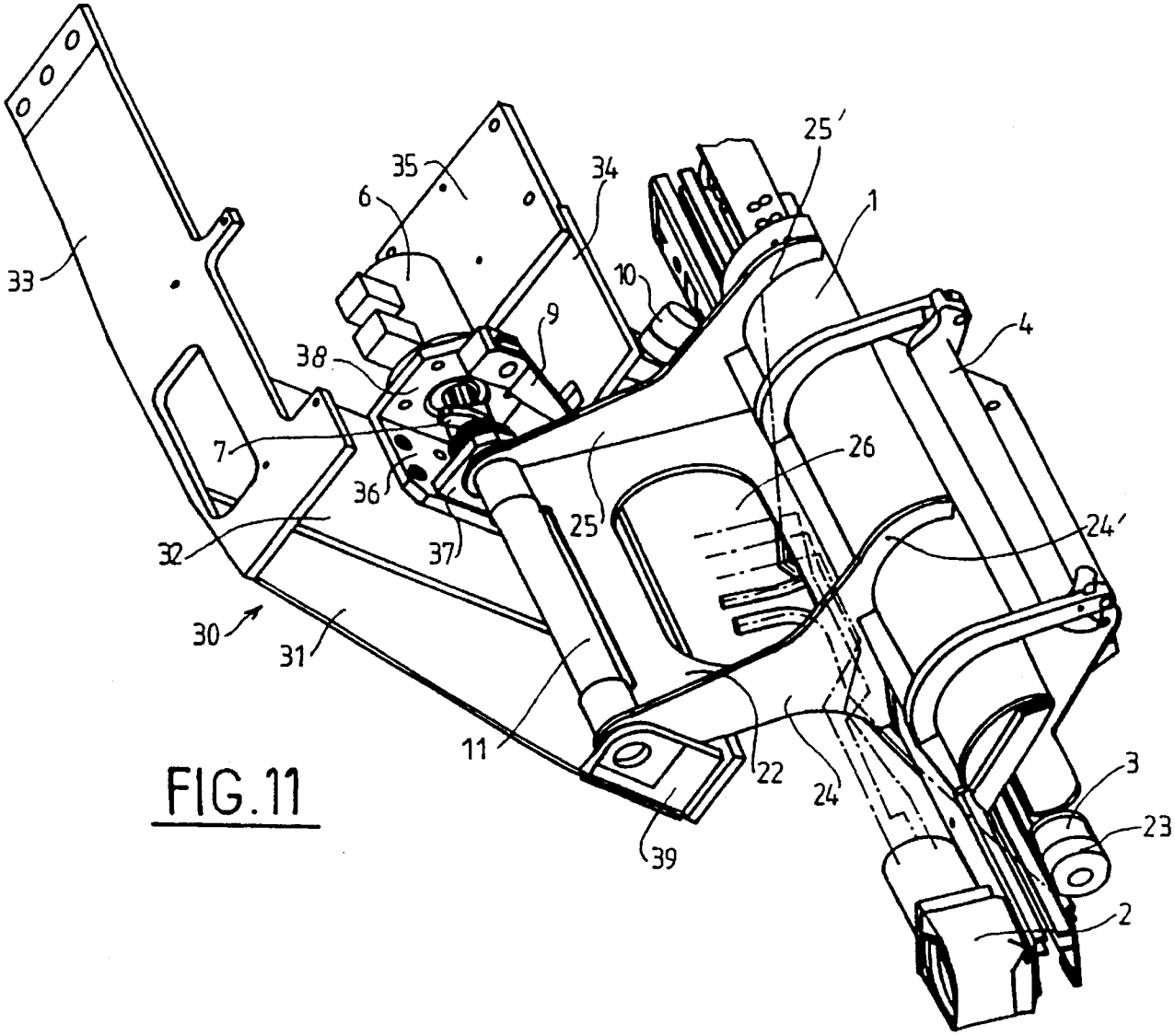
FIG. 11 is a perspective view of a device according to the invention, with the retraction device of the retractable stop removed.

The fork 8 is thus displaceable between the active position of lever 7 (solid lines in FIG. 10) in which the pin 18 can make the second lever 9 turn, and a second position, forming an angle with the vertical, in which, with the actuator 5 in the extended piston position, the pin 18 is displaced (to the right in FIG. 10) so as to move away from the second lever 9 (dashed lines in FIG. 10).

FIG. 8 also shows the various positions of levers 7 and 9, more particularly the three characteristic positions of the lever 7, namely the first starting position shown with solid lines, then, after the first rotation, the first position corresponding to arrival of the second lever 9 at its stop (also shown with dashed lines), then finally, as the rotation continues counter-clockwise, the third position after the second rotation, in which a rear extension 19 of the lever 7 comes to rest against a stop 13 indicating the end of the second rotation.

What is claimed is:

1. A mechanism for inserting a munition into a breech chamber of a weapon, comprising:

a drive device that includes a drive element having an axis of rotation that drives said mechanism through a first rotation and a second rotation, said first rotation and said second rotation being about said axis of rotation;

a munition feed device that transports and feeds the munition, said munition feed device being coupled to and rotationally driven by said drive device from an initial position through said first rotation to a ramming position and through said second rotation from said ramming position to a locking position;

a ramming device connected to and disposed to rotate with said munition feed device, wherein when said mechanism is in said ramming position, said ramming device is aligned with and disposed to ram the munition into the breech chamber;

a locking device shaped to lock the munition, said locking device being connected to and disposed to rotate with said munition feed device, wherein when said mechanism is in said locking position, said locking device is aligned with and disposed to lock the munition within the breech chamber; and a retractable stop assembly coupled to and shaped to cooperate with said munition feed device to stop said munition feed device after said first rotation such that said mechanism is disposed in said ramming position.

2. The mechanism of claim 1, wherein said retractable stop assembly includes a retraction device and a stopping device connected to said retraction device, said retraction device being movable to displace said stopping device between a stop position in which said stopping device contacts and stops said munition feed device and an inactive position in which said stopping device retracts and allows said munition feed device to rotate.

3. The mechanism of claim 2, wherein said stopping device includes a first stop lever disposed to rotate with and to slide axially along said drive element, and wherein said retraction device includes an engaging member disposed to urge said stopping device to slide axially along said drive element.

4. The mechanism of claim 3, wherein said first stop lever includes a peripheral groove and said engaging member has a fork shaped to engage said peripheral groove.

5. The mechanism of claim 3, wherein said stopping device includes a second stop lever driven by said first stop lever during said first rotation until said second stop lever contacts an end stop.

6. The mechanism of claim 3, wherein said stopping device includes splines and said drive element includes grooves shaped to cooperate with said splines such that said stopping device is slideable along and rotationally coupleable with said drive element.

7. The mechanism of claim 4, wherein said stopping device includes a second stop lever driven by said first stop lever during said first rotation until said second stop lever contacts an end stop.

8. The mechanism of claim 4, wherein said fork is disposed to pivot about a pivot point.

9. The mechanism of claim 8, wherein said engaging member includes an actuating pin disposed on an end of said first leg.

10. The mechanism of claim 4, wherein said fork includes a first leg having a first pin and a second leg having a second pin, said first pin and said second pin being engageable with said peripheral groove.

11. A method of inserting a munition into a breech chamber of a weapon with a mechanism, said mechanism having a drive device with a drive element, a munition feed device rotationally coupled to said drive element, a ramming device and a locking device coupled to said munition feed device and a retractable stop assembly coupled to said drive element and said munition feed device, said method comprising:

rotating said munition feed device and the munition with said drive element from an initial position through a first rotation to a ramming position in which said ramming device is aligned with the breech chamber;

stopping said munition feed device with said retractable stop at said ramming position;

ramming the munition into the breech chamber with said ramming device;

rotating said munition feed device with said drive element through a second rotation from said ramming position to a locking position in which said locking device is aligned with said munition and said breech chamber; and locking the munition within the breech chamber with said locking device.

12. The method of claim 11, wherein said stopping step includes moving said retractable stop assembly between an inactive position and a stop position.

13. The method of claim 11, further comprising rotating said munition feed device in a return rotation with said drive element from said locking position to said initial position.

14. The method of claim 11, further comprising retracting said retractable stop to release said munition feed device.

15. The method of claim 14, wherein said retracting step occurs after said locking step.

16. The method of claim 11, further comprising retracting said retractable stop to release said munition feed device after said locking step and rotating said munition feed device in a return rotation with said drive element from said locking position to said initial position.

17. The method of claim 11, wherein said step of ramming includes moving said ramming device forward to move the munition into the breech chamber.

18. The method of claim 17, wherein said step of ramming includes moving said ramming device rearward to return said ramming device to a starting position.

19. The method of claim 11, wherein said step of locking includes moving said locking device forward to lock the munition into the breech chamber and moving said locking device rearward to return said locking device to a starting position.

20. The method of claim 11, wherein said steps of rotating said munition feed device occur in a first direction, said method further comprising the step of returning said munition feed device from said locking position to said initial position in a return rotation, said return rotation being in a second direction opposite said first direction.

* * * * *